US007678358B2

(12) United States Patent
Eckert et al.

(10) Patent No.: US 7,678,358 B2
(45) Date of Patent: Mar. 16, 2010

(54) CARBON FIBERS FROM KRAFT SOFTWOOD LIGNIN

(75) Inventors: Robert C Eckert, Auburn, WA (US); Zia Abdullah, Federal Way, WA (US)

(73) Assignee: Weyerhaeuser NR Company, Federal Way, WA (US)

( * ) Notice: Subject to any disclaimer, the term of this patent is extended or adjusted under 35 U.S.C. 154(b) by 196 days.

(21) Appl. No.: 11/767,608

(22) Filed: Jun. 25, 2007

(65) Prior Publication Data

US 2008/0317661 A1 Dec. 25, 2008

(51) Int. Cl.
*D01F 9/12* (2006.01)

(52) U.S. Cl. ..... 423/447.4

(58) Field of Classification Search ..... None
See application file for complete search history.

(56) References Cited

U.S. PATENT DOCUMENTS

| | | | |
|---|---|---|---|
| 2,429,102 | A | 10/1947 | Lewis et al. |
| 2,464,828 | A | 3/1949 | Pollack et al. |
| 2,623,040 | A | 12/1952 | Keilen et al. |
| 2,813,090 | A | 11/1957 | Ball |
| 2,997,466 | A | 8/1961 | Ball et al. |
| 3,048,576 | A | 8/1962 | Ball et al. |
| 3,461,082 | A | 8/1969 | Otani et al. |
| 3,723,609 | A | 3/1973 | Mansmann |
| 5,344,921 | A | 9/1994 | Sudo |

FOREIGN PATENT DOCUMENTS

GB 1 282 500 7/1972

OTHER PUBLICATIONS

Merkle, Gerhard et al, Light Scattering of Acetylated Lignin, 1992, Journal of Applied Polymer Science, vol. 45, pp. 407-415.*

Kubo, S. et al, Preperation of carbon fibers from softwood lignin by atmospheric acetic acid pulping, 1998, Carbon, vol. 36, No. 7-8, pp. 1119-1124.*

Kadla, J. et al, Lignin- based carbon fibers for composite fiber applications, 2002, Carbon, vol. 40, pp. 2913-2920.*

Glasser WG et al., "Alkanoates I: Lignin derivatives," *Holzforschung* vol. 47, No. 3, pp. 225-233 (1993).

Young RA, "Cross-linked cellulose and cellulose derivatives," *Absorbent Technology 2020*, pp. 23-281 (2002).

Dean WL, "Cross-linked derivative (CLD) fibers as binders for nonwovens," *Tech Symp-Nonwoven Product Tech*, INDA, New York, pp. 155-163 (1971).

Podlas TJ, "Internally crosslinked carboxymethylcellulose fibers for absorbent nonwovens applications," *Tech Symp-Nonwoven Product Tech*, INDA, New York, pp. 25-39 (1971).

Nelson CM et al, "Conversion of lignin into a precursor for the production of graphitic carbon materials," *Proceedings of the biomass conf of the American Energy, Environment, Agriculture and Industry*, 2nd, Portland, OR Aug. 21-24, 1995, NREL Golden, CO.

Glasser W et al, "Lignin derivatives," *Holzforchung* V. 47 No. 3(1993).

Glasser W et al, "Atructure property relationships of engineering plastics from lignin," *Proceedings of the 1986 TAPPI R&D Conf*, Raleigh NC Sep. 28-Oct. 1, 1986.

Kadla JF, et al, "Lignin-based carbon fibers," *Chemical Modification, Properties and Usage of Lignin*, TQ Hu, Ed., Kluwer Academic/ Plenum Pub. (2002).

Kubo S, et al, "Preparation of Lignin fibers from softwood acetic acid lignin-relationship between fusibility and the chemical structure of lignin," *Mokuzai Gakkaishi*, vol. 43, No. 8 pp. 655-662, 1997.

Kubo S, et al, "Preparation of carbon fibers from softwood lignin by atmospheric acetic acid pulping," *Carbon*, vol. 36, No. 7-8 pp. 1119-1124, 1998.

Kadla JF, et al, "Lignin-based carbon fibers for composite fiber applications," *Carbon*, pp. 2913-2920, 2002.

Uraki Y et al, "Preparation of carbon fibers from organosolv lignin obtained by aqueous acetic acid pulping," *Holzforchung* V. 49 No. 4, pp. 127-134(1995).

* cited by examiner

*Primary Examiner*—Melvin C Mayes
*Assistant Examiner*—Stefanie Cohen
(74) *Attorney, Agent, or Firm*—John M. Crawford

(57) ABSTRACT

A method of making a carbon fiber from softwood alkaline black liquor lignin by acetylating the lignin to provide a meltable and drawable lignin.

12 Claims, 5 Drawing Sheets

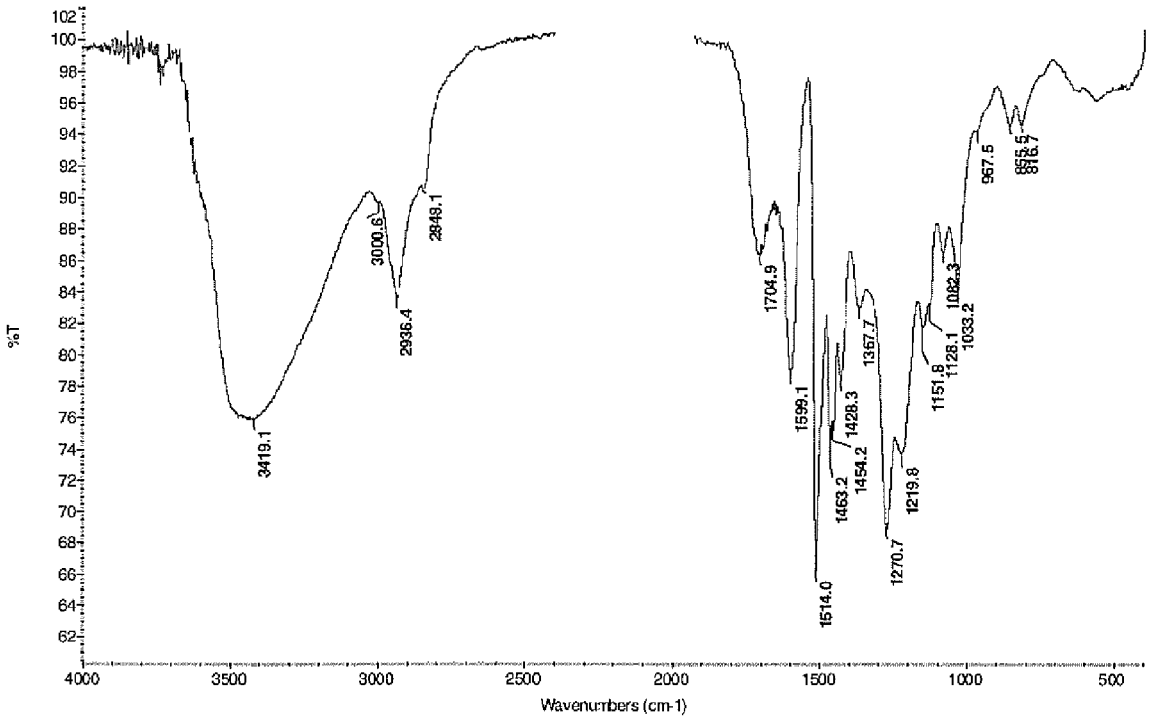
Figure 1: FTIR of softwood kraft lignin precipitated at pH 8. Absorption band at 3419 indicates hydroxyl groups

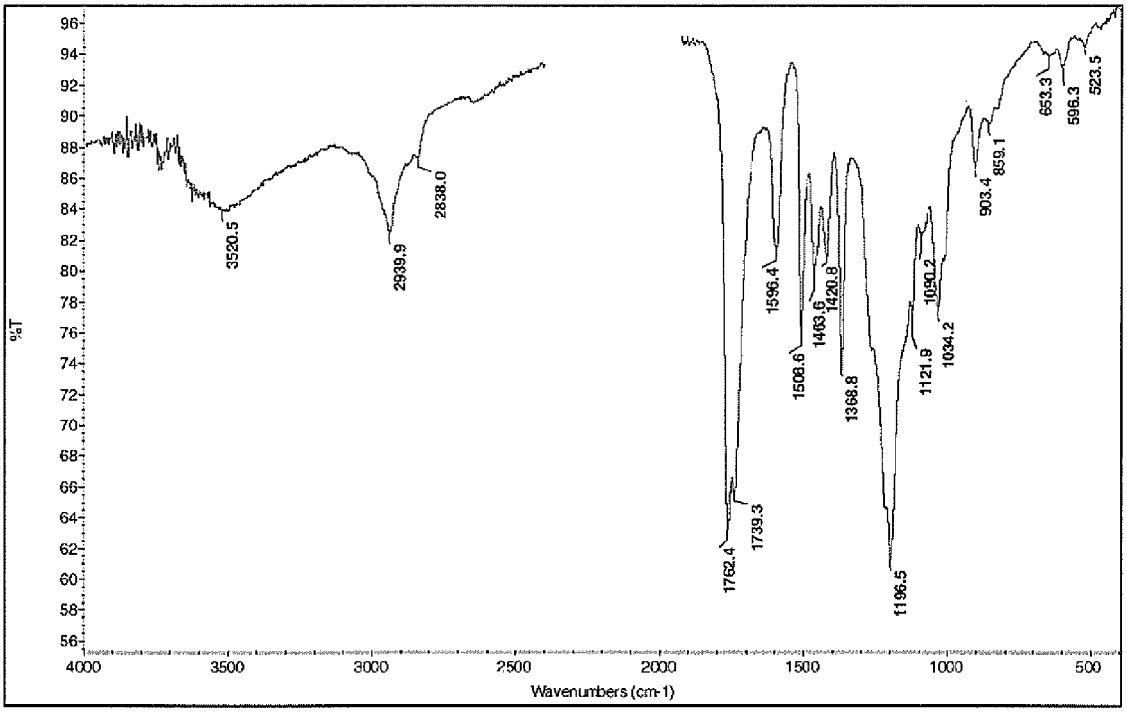
Figure 2: FTIR of softwood kraft lignin precipitated at pH 8 and acetylated. Absorption band centered around 1750 indicates acetyl groups.

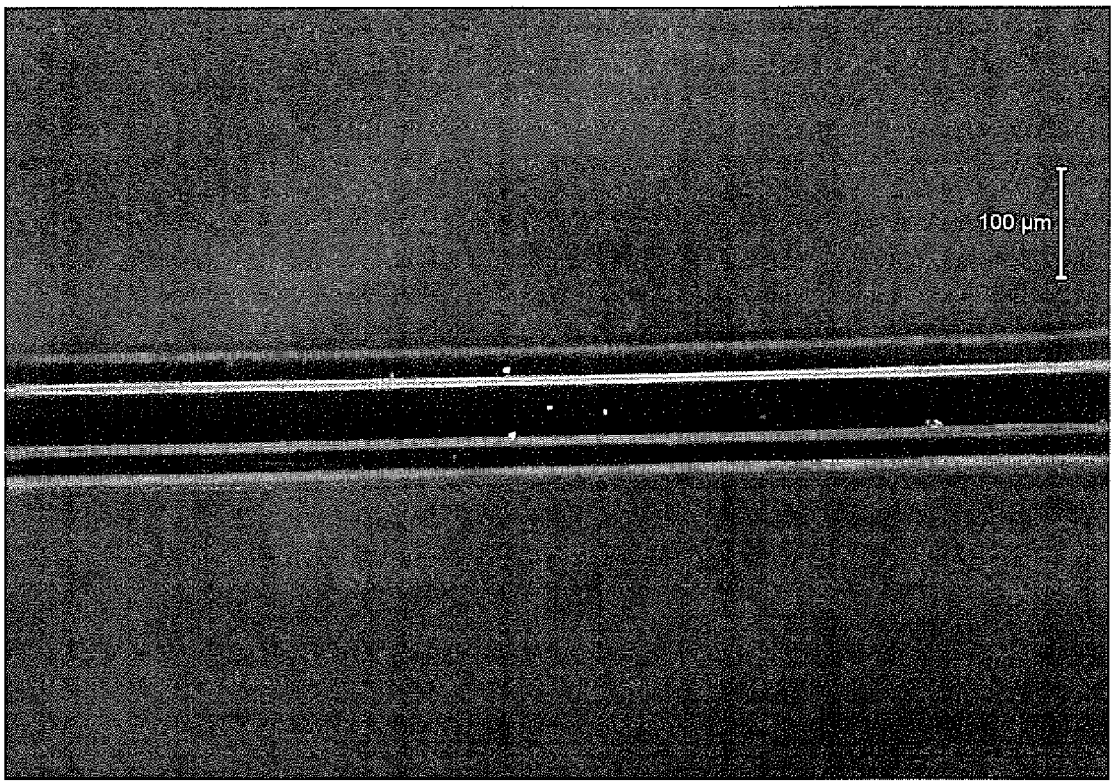
Figure 3: Photomicrograph of an acetylated kraft softwood lignin fiber

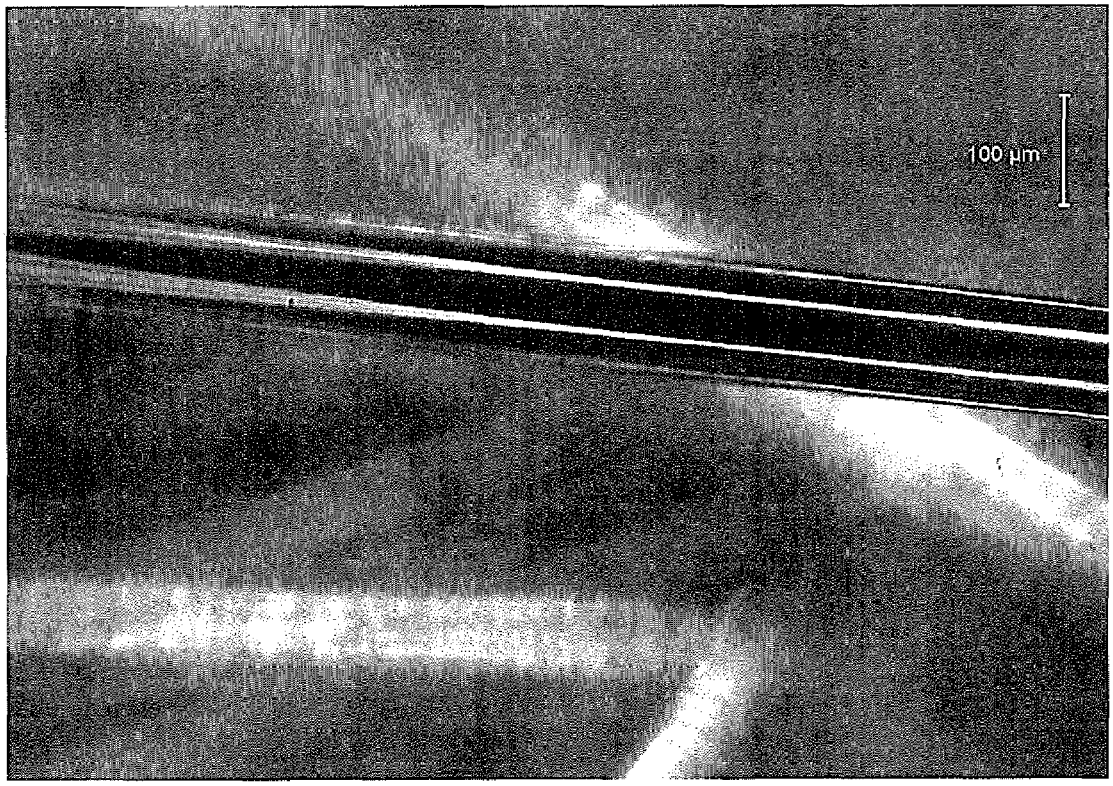
Figure 4: Photomicrograph of the oxidized lignin fiber. The background image shows the grain boundaries of the platinum plate on which the fiber is mounted.

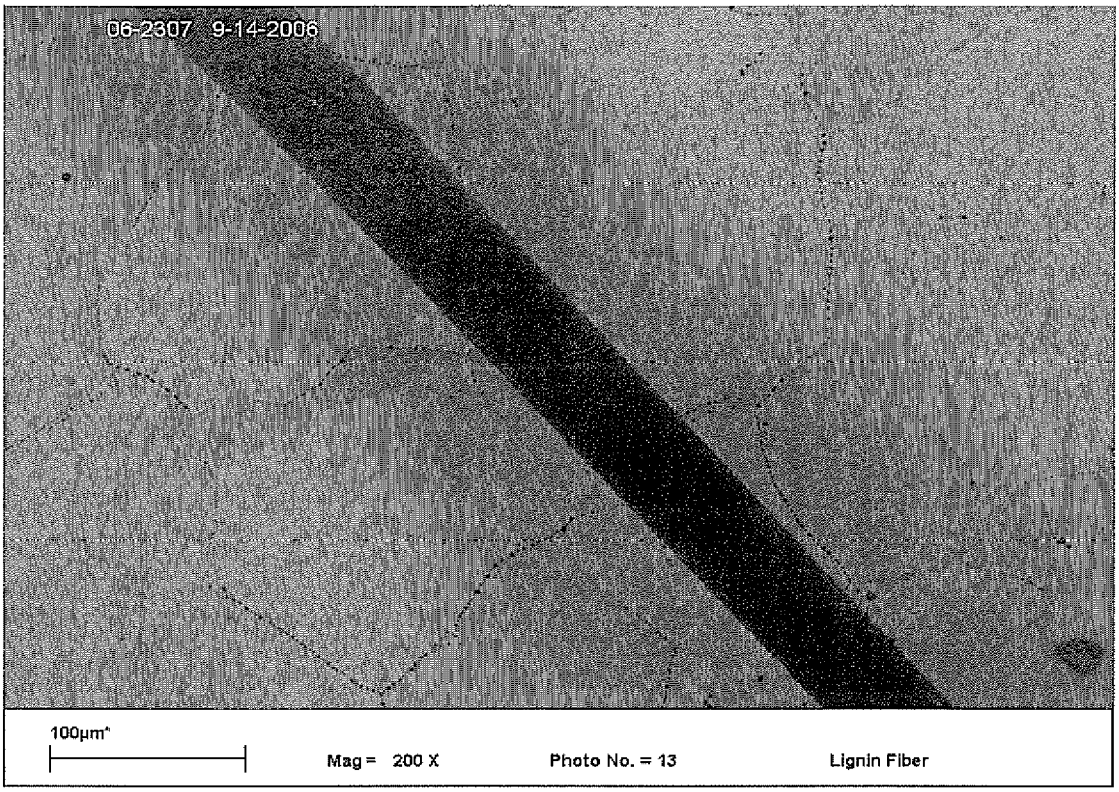
Figure 5: SEM of the carbonized lignin fiber. . The background image shows the grain boundaries of the platinum plate on which the fiber is mounted.

CARBON FIBERS FROM KRAFT SOFTWOOD LIGNIN

The present invention is directed to the manufacture of carbon fibers from melt spinning lignin obtained from kraft pulping of softwood.

BACKGROUND

Carbon fibers are high value products with a rapidly growing range of applications. Precursor materials used for carbon fiber manufacture include primarily polyacrylonitrile (PAN) and Pitch. Since both of these materials originate from the petrochemical industry, raw material costs have been increasing, and there is interest in finding precursor materials which are not directly coupled to the price of oil.

Lignin has been suggested as a promising lower cost precursor material for carbon fiber manufacture. Lignin is the most abundant organic material on earth after cellulose, and makes up about one quarter to one third of the mass of dry wood. It is the major by-product of the pulp and paper industry and is separated from the cellulose using pulping processes. During these processes the lignin is solubilized by cooking chemicals and migrates from the wood chip to the cooking liquor. At the end of the pulp cook the spent cooking liquor with its load of organic material including lignin, now called black liquor, is separated from the cellulose. Commercial pulping processes include the soda, the sulfite and the sulfate (also known as kraft) processes. This invention relates specifically to the lignin obtained from softwood pulped using the alkaline kraft or soda processes. In these processes the lignin, dissolved in alkaline black liquor, is combusted in a recovery boiler to produce energy.

Since the kraft process is predominant in the pulp and paper industry, and softwoods are a significant raw material source to this industry, softwood kraft lignin is a major widely produced and available commercial product. To date, the researchers and journals have expressed the opinion that softwood lignin cannot be formed into carbon fiber without the substantial use of additives (solvents) and other enhancements to make the lignin additive admixture meltable and drawable into fibers. To the best of our knowledge, there is no disclosure which describes green lignin fibers melt extruded primarily from softwood lignin or its derivatives, without substantial use of solvents or additives. Accordingly, there is a need to develop a methodology to convert this widely available material into a precursor for carbon fibers.

BRIEF DESCRIPTION OF THE DRAWINGS

FIGS. 1 and 2 are FTIR spectra of a kraft softwood lignin.

FIG. 3 shows a photo micrograph of a lignin fiber.

FIG. 4 shows a photograph of a thermally stabilized acetylated lignin fiber.

FIG. 5 is a SEM image of the carbonized fiber.

DETAILED DESCRIPTION OF THE INVENTION

Softwood alkali lignin is obtained from the black liquor from softwood alkali pulping processes. In the manufacture of wood pulp, some of the lignin and hemicelluloses are solubilized and separated from the cellulose. The black liquor from the pulping process is the solubilized lignin and hemicellulose.

The softwoods that can be used in the pulping process are any of the coniferous species and can include fir, Douglas fir, pine, spruce, hemlock and larch.

The present invention provides a method which converts commercial softwood alkali lignin into a form which can be melted and extruded into lignin fibers.

This method renders the kraft softwood lignin to a form which can not only be melted and thermally extruded, but also allows the lignin fiber to be thermally stabilized. The thermally stabilized lignin fibers can be carbonized into carbon fibers using conventional techniques.

The method is characterized by acetylating the kraft softwood lignin such that the acetyl content of the lignin is at least 16% by weight, and at the same time, the lignin is not cross linked sufficiently to prevent melting.

In the process, the softwood kraft black liquor is filtered to remove extraneous material.

The pH of the softwood kraft black liquor is approximately 13. Treatment with acid lowers the pH and precipitates the lignin. The acid can be $CO_2$, or a mineral acid such as hydrochloric acid, sulfuric acid or nitric acid. The acid treatment can be at ambient or at elevated temperature. In one embodiment the lignin precipitation is done at 80° C. The pH of the black liquor can be lowered to any pH. In one embodiment the pH of the black liquor is lowered to pH 8 to precipitate the lignin. The precipitate from the acid treatment is separated, after coagulation, from the slurry by centrifugation, filtration or decanting.

The precipitated lignin is then washed by acid and dionized water until the ash level is less than 0.1%. The lignin is then air dried, and if necessary, ground to pass a 100 mesh screen.

The above lignin is then acetylated. Chemicals which can be used for acetylation include but are not limited to acetyl chloride, acetic anhydride and acetic acid. It has been found that the lignin can be acetylated without a catalyst and without incurring cross linking reactions. This requires that the lignin is acetylated at a temperature of between 70° C. and 100° C. In one embodiment the temperature is around 80° C. In another embodiment the temperature is between 75° C. and 85° C.

A catalyst may be used to significantly reduce the time and temperature of the acetylation reaction, and avoid thermal and acid catalyzed cross linking of the lignin. Preferred catalysts for obtaining meltable lignin acetate include organic amines, in particular tertiary amines such as tri-ethyl amine, tri-methyl amine and pyridine. The temperatures at which the reaction can occur are in the range of 0° C. and 100° C. In one embodiment the temperature is approximately 50° C.

The acetyl content of the lignin acetate should be high enough to allow melting when heated. Insufficient acetyl content will lead to charring of the lignin before melting takes place. The lignin acetate should still be sufficiently reactive to thermally stabilize (i.e. cross link sufficiently to prevent further melting) when the green lignin fiber is heated post extrusion. It has been found that to meet these conditions for kraft softwood lignin, the acetyl groups have to comprise at least 16% by weight, and preferably over 18% by weight of the dry lignin acetate, as measured by de-acetylation in alkali followed by ion chromatography. In one embodiment the acetyl groups comprise 18% by weight of the dry lignin acetate as measured by de-acetylation in alkali followed by ion chromatography. In one embodiment acetylation will reach a maximum of 22% by weight acetyl groups as measured by de-acetylation in alkali followed by ion chromatography.

The process of de-acetylation in alkali followed by ion chromatography is as follows: The acetylated lignin is dissolved in an alkali solution (NaOH) and heated. The hydroxyl ions in the solution strip the acetyl group from the lignin molecule. The acetyl group reacts with the sodium, producing sodium acetate. The sodium acetate is passed through an ion exchange column where the acetate is captured and quantified using standard methods which have been calibrated previously for acetate.

FTIR (Fourier Transform Infrared) is an infrared spectroscopy method, in which IR radiation is passed though a sample. Some of the IR energy is absorbed by the sample and some of it is transmitted through. A detector measures the frequency (or wavelength) and intensity of the energy passed through the sample, and generates a frequency spectrum using Fourier transformation.

FIG. 1 is a FTIR spectrum of a kraft softwood lignin that was precipitated at pH 8. The absorption at wave number 3419 shows the presence of "—OH" group. FIG. 2 is a spectrum of the same lignin which has been well acetylated. The absorption band at wave number of 3419 has disappeared, which means that the "—OH" groups have been eliminated. The new band centered approximately at wave number 1750 corresponds to the acetyl groups which are now in the positions that the "—OH" previously occupied in the lignin molecule.

It was found, following the method taught by Mansmann et al. U.S. Pat. No. 3,723,609, that when a small amount of lignin acetate having at least 16% by weight acetyl groups was melted in a test tube and a wooden stick was dipped in the melt and withdrawn, thin long lignin filaments were obtained.

It was found that the softwood lignin, after acetylation to at least 16% acetyl groups by weight, could be melt extruded into "green lignin" fibers which were several centimeters long, and which had diameter range of 10 microns to 100 microns. The diameter could be as low as 5 microns. The melt extrusion was done using a heated, high pressure stainless steel syringe, with nozzles which had diameter range of 75 microns to 500 microns, and temperature setting in the range of 180° C. to 220° C., In one embodiment the diameter was 125 microns. In one embodiment the temperature setting would be around 200° C.

It was found that the "green lignin" melt extruded fibers could be thermally stabilized, in air, in a furnace ramped at 0.2° C. per minute to 240° C., held at 240° C. for 2 hours and cooled to ambient temperature.

It was found that the thermally stabilized lignin fibers could be carbonized, in nitrogen, in a furnace ramped at 4° C. per minute to 1150° C., held at 1150° C. for 2 hours and cooled to ambient temperature.

It was found that carbon fibers can be successfully made from melt spun softwood kraft lignin, if it is sufficiently acetylated.

If desired, the lignin can be mixed with various additives used in carbon fiber to increase its ductility and otherwise enhance the fiber properties.

EXAMPLES OF THE INVENTION

The following examples illustrate the practice of the present invention. This invention is not limited by these examples.

Example 1

Preparation of the Raw Material for the Invention

Lignin was precipitated at 80° C. from the softwood kraft black liquor by acidifying with 4N sulfuric acid in a water bath. The pH of the softwood kraft black liquor was reduced to pH 8 and a precipitate formed. The precipitate was filtered from the solution. The precipitate was re-suspended in 4N sulfuric acid to desalt the lignin. The precipitate was again filtered from the solution. The precipitate was re-suspended in DI water and filtered. This procedure was repeated until the ash content was less than 0.1%. The lignin was then air dried.

Example 2

Testing the Softwood Lignin for Melting

A 0.1 g sample of lignin from example 1 was placed in a test tube and the test tube was placed in the heating block. The lignin was heated progressively to 250° C. No melting behavior was observed. The lignin blackened, sintered and charred.

Example 3

Sufficient Acetylation with Catalyst

Approximately 2.0 g of lignin from example 1 was acetylated at 50° C. for 8 hours in 20 ml of 1:1 mixture of pyridine catalyst and acetic anhydride. The material was precipitated in ice-water. The precipitate was filtered from the water, washed and dried in air. The acetyl content was 21.9% as measured by de-acetylation in alkali followed by ion chromatography.

A 0.1 g sample of the acetylated lignin was placed in a test tube and placed in the heating block. The acetylated lignin melted smoothly at 220° C. without production of volatiles. A slender lignin filament was readily drawn from the molten lignin.

Example 4

Insufficient Acetylation without Catalyst

Approximately 0.5 g of lignin from example 1 was suspended in 2 ml. of acetic anhydride in a test tube. No catalyst was used. The suspension was heated for 1 hour at 80° C. The acetic anhydride was evaporated off. The lignin was washed with methanol and air dried. The acetyl content was 12.5% as measured by de-acetylation in alkali followed by ion chromatography.

A 0.1 g sample of the acetylated lignin was placed in a test tube, heated progressively and observed. At 250° C. the acetylated lignin showed some softening and it then charred. No lignin fiber could be drawn from this sample.

Example 5

Sufficient Acetylation without Catalyst

A 2 g sample of lignin from example 1 was suspended in 10 ml of acetic anhydride in a test tube. No catalyst was used. The suspension was heated for 2 hours at 80° C. The acetic anhydride was evaporated off. The lignin was washed with methanol and air dried. The acetyl content was 19.3% as measured by de-acetylation in alkali followed by ion chromatography.

A 0.1 g sample of the acetylated lignin was placed in a test tube and heated. At 220° C. the acetylated lignin melted smoothly without the production of volatiles. A thin filament could be drawn smoothly from the molten lignin.

Example 6

Melt Extrusion of Softwood Lignin Green Fibers 300 mg of acetylated lignin prepared as in example 3 was spread out on a watch glass placed in a vacuum furnace. The furnace was heated to 140° C. and evacuated to −0.8 bar. The sample remained in the furnace for one hour. This dried the lignin and removed any volatiles. The dried lignin was ground with a pestle in a mortar to a size to pass a 100 mesh screen.

200 mg of the dried ground acetylated lignin was placed in a stainless steel syringe equipped with four nozzles of 125 micron diameter. The syringe was heated to 220° C. at a rate of 1.7° C. per second, using 600 Watt band heaters. The plunger of the syringe was driven by a screw press. Softwood lignin fibers were extruded from the nozzles. The diameter of the acetylated lignin fibers ranged from approximately 100 microns to less than 10 microns. Fibers which were tens of centimeters long were extruded using this procedure. FIG. 3 shows a photo micrograph of a lignin fiber.

Example 7

Thermal Stabilization Softwood of the Lignin Green Fibers

Segments of the acetylated lignin fibers were mounted on a platinum plate using high temperature ceramic cement. The acetylated lignin fibers were then heated in a furnace in an air atmosphere at a rate of 0.2° C. per minute up to a temperature of 240° C. The furnace temperature was maintained at 240° C. for 2 hours. The furnace was then cooled down to ambient. This thermally stabilized the acetylated lignin fibers. FIG. 4 shows a photograph of a thermally stabilized acetylated lignin fiber. The background shows the grain boundaries of the platinum plate on which the fiber is mounted.

Example 8

Carbonization of the Fibers

The thermally stabilized acetylated lignin fibers were mounted on a platinum plate and heated in a tube furnace in a nitrogen atmosphere to a temperature of 1150° C. at a rate of 4° C. per minute. The furnace temperature was maintained at 1150° C. for 2 hours. The furnace was allowed to cool to ambient temperature. This carbonized the fibers. FIG. 5 is a SEM image of the carbonized fiber. The background shows the grain boundaries of the platinum plate on which the fiber is mounted. Carbon content in excess of 90% was achieved as measured by EDAX analysis.

While the preferred embodiments of the invention has been illustrated and described, it will be appreciated that various changes can be made therein without departing from the spirit and scope of the invention.

The invention claimed is:

1. The process of forming a carbon fiber from kraft softwood lignin comprising:

a) acetylating lignin obtained from softwood alkaline black liquor to provide a lignin acetate until the acetyl content of the dry lignin acetate is between 16% and 22% by weight as measured by deacetylation in alkali followed by ion chromatography wherein the lignin acetate melts when heated b) melt extruding the acetylated softwood acetylated lignin to provide a coherent "green" lignin fiber c) thermally stabilizing the melt extruded green lignin acetate fiber to a state that does not melt on subsequent heating d) carbonizing thermally stabilized softwood lignin acetate fiber.

2. The process of claim 1 wherein the acetylation step is performed using acetyl chloride, acetic anhydride or acetic acid.

3. The process of claim 1 wherein the acetylation step is performed without using a catalyst.

4. The process of claim 3 wherein the acetylation step is performed at a temperature in the range of 70 to 100° C.

5. The process of claim 3 wherein the acetylation step is performed at a temperature in the range of 75 to 85° C.

6. The process of claim 2 wherein the acetylation step is performed using a catalyst.

7. The process of claim 6 wherein the catalyst is an organic amine.

8. The process of claim 6 wherein the catalyst is pyridine, tri-ethyl amine or tri-methyl amine.

9. The process of claim 6 wherein the acetylation step is performed at a temperature of 100° C. or less.

10. The process of claim 8 wherein the acetylation step is performed at a temperature of 45 to 55° C.

11. The process of claim 1 wherein the green lignin fiber has a diameter of 5 to 100 microns.

12. The process of claim 11 wherein the green lignin fiber has a diameter of 10 to 50 microns.

* * * * *